US007922889B2

(12) United States Patent
Critchlow et al.

(10) Patent No.: US 7,922,889 B2
(45) Date of Patent: Apr. 12, 2011

(54) ANODISING ALUMINUM ALLOY

(75) Inventors: Gary Critchlow, Loughborough (GB); Ian Ashcroft, Loughborough (GB); Timothy Cartwright, Thatcham (GB); David Bahrani, Northern Island (GB)

(73) Assignee: Short Brothers PLC, Belfast Northern Ireland (GB)

( * ) Notice: Subject to any disclaimer, the term of this patent is extended or adjusted under 35 U.S.C. 154(b) by 693 days.

(21) Appl. No.: 11/794,889

(22) PCT Filed: Jan. 10, 2006

(86) PCT No.: PCT/GB2006/000077

§ 371 (c)(1),
(2), (4) Date: Nov. 23, 2007

(87) PCT Pub. No.: WO2006/072804

PCT Pub. Date: Jul. 13, 2006

(65) Prior Publication Data

US 2008/0213618 A1 Sep. 4, 2008

(30) Foreign Application Priority Data

Jan. 10, 2005 (GB) ..... 0500407.2

(51) Int. Cl.
*C25D 11/04* (2006.01)

(52) U.S. Cl. ..... 205/324; 205/328

(58) Field of Classification Search ..... None
See application file for complete search history.

(56) References Cited

U.S. PATENT DOCUMENTS

| | | | | |
|---|---|---|---|---|
| 4,152,158 | A | 5/1979 | Chu | |
| 4,545,866 | A | 10/1985 | Ohba | |
| 4,894,127 | A | 1/1990 | Wong et al. | |
| 5,486,283 | A | 1/1996 | Mnich | |
| 6,197,178 | B1 * | 3/2001 | Patel et al. | 205/81 |

FOREIGN PATENT DOCUMENTS

| | | | |
|---|---|---|---|
| GB | 374806 | A | 6/1932 |
| JP | 53011135 | A | 2/1978 |
| JP | 62027591 | A | 2/1987 |

* cited by examiner

*Primary Examiner* — Timothy M Speer
(74) *Attorney, Agent, or Firm* — Thomas & Karceski, P.C.

(57) ABSTRACT

An anodic oxide film is formed on an aluminium or aluminium alloy work piece by forming an anodic oxide film on the work piece by AC electrolysis followed by subjecting the work piece to DC electrolysis. The AC anodizing step may be conducted at a voltage of 5 to 30V for 30 seconds to 10 minutes and the DC anodizing step may be conducted at a voltage of 5 to 30V for a period of 1 to 20 minutes. The anodic oxide coating is suitable for adhesive bonding of aluminium alloy work pieces.

13 Claims, 4 Drawing Sheets

Approx 2 micrometres thick

ANODISING ALUMINUM ALLOY

CROSS-REFERENCE TO RELATED APPLICATIONS

This application is a National Phase Application based upon and claiming the benefit of priority to PCT/GB2006/000077, filed on Jan. 10, 2006, which is based upon and claims the benefit of priority to Great Britain Patent Application No. 0500407.2, filed Jan. 10, 2005, the contents of both of which are incorporated herein by reference.

The invention relates to the formation of anodic oxide films on aluminium or aluminium alloys which is particularly, but not exclusively, useful to the aerospace and automobile industries where aluminium alloys (typically 2000, 5000, 6000 and 7000 series) are provided with a coating of aluminium oxide or hydrated oxide by an anodising process. More particularly the process provides an anodic oxide coating which is suitable for adhesive bonding of aluminum alloy workpieces.

Within the aerospace and automobile industries, and in other similar industries, aluminium alloy structures are anodised for two main reasons. Firstly, to create a layer of aluminium oxide or hydrated oxide (hereafter called the anodic oxide film) on the surface of the component to provide an impermeable barrier, thereby protecting the component from atmospheric corrosion. Secondly, to create a layer on the surface of a component to act as an adherent surface for a range of organic coatings including primers, coupling agents, lacquers adhesives and paints. The specific function of the anodic coating is determined by its thickness and degree of porosity. Thicker less porous coatings provide corrosion protection whilst thinner more porous coatings provide highly adherent surfaces for adhesive bonding and painting. The thickness and degree of coating porosity depend on the specific anodising process used to treat the component.

The currently available anodising technologies include the following:

For structures that will be subsequently organic coated, anodising using either an AC or DC current, but not both. For structures that will be receptive to colourants a combination of DC then AC processing is used. In the first case, parts are immersed in an acid solution and attached to the anode with cathodes along the walls of the tank. When DC current is passed negatively charged oxygen ions migrate towards the positively charged part. A reaction between the aluminium alloy surface and the oxygen causes aluminium oxide to grow from the surface of the component. However, as this coating grows it is also being dissolved by the acid solution. The rate of coating growth and the rate of dissolution are dependant upon the various process parameters such as acid type and concentration, temperature and anodising voltage. The porosity of the coating is also dependant upon these factors. Examples of currently available anodising processes are:

a. Phosphoric acid anodising. This produces a very thin (less than 1 micrometer) oxide coating that is very porous. It provides a highly adherent surface for adhesives or paint but is so thin and porous that it gives little corrosion protection to the substrate.
b. Sulphuric acid anodising. This produces a thicker (up to 30 micrometers) coating with less porosity. This provides good corrosion protection to the substrate due to the thicker less porous oxide but is relatively poor for adhesive bonding.
c. Chromic acid anodising. This process produces an oxide coating thickness of between 1 and 4 micrometers in thickness. The oxide is less porous than those produced by the phosphoric acid process. The pore diameter for this process is typically about 30 nanometers, which makes it suitable for adhesive bonding as the primer or adhesive molecules can penetrate into the pores. It is also a suitable surface for painting. This process also provides some degree of corrosion protection, as it is thicker and less porous than the phosphoric acid process. The porosity of these oxide surfaces can be reduced by sealing the surface by immersion in hot deionised water or in a dilute chromate solution. This causes the oxide to hydrate and swell causing the pores to reduce in size. A sealed oxide is unsuitable for adhesive bonding but is still suitable for painting.
d. Boric acid sulphuric acid anodising. U.S. Pat. No. 4,894,127. This produces oxides similar to that for the chromic acid process except that the pore diameter is typically less than 30 nanometers. This makes the process unsuitable for adhesive bonding. Corrosion protection is improved by sealing the oxide coating. This process is considered to be a chromate free alternative to chromic acid anodising for corrosion protection and paint adhesion.

A number of problems exist with the currently available processes listed above.

1. The deoxidise processes causes a reduction in fatigue life of the component due to the creation of etch pits in the surface of the aluminium alloy. In addition, thicker oxide coatings also reduce the fatigue life.
2. None of the processes listed above produce an oxide coating possessing maximum corrosion protection whilst also allowing maximum adhesion for bonding. Bulk properties of a coating can be varied but increased porosity required for adhesive bonding will result in reduced corrosion protection and vice versa. Therefore optimum properties for an oxide coating suitable for adhesive bonding cannot be achieved.
3. In all cases, except with phosphoric acid anodising, the oxide formed will absorb moisture from the atmosphere and hydrate. This causes the oxide to swell and the pore size to reduce making the surface unsuitable for adhesive bonding or painting. To overcome this an adhesive primer or paint must be applied within a specified time period, typically 16 hours maximum, after anodising to ensure that hydration is minimised and maximum properties from the oxide are achieved. In the case of phosphoric acid anodised surfaces an adhesive primer or paint must still be applied. However, in this case it is to provide corrosion protection to the component as the oxide coating possesses no corrosion inhibiting properties. A chromated adhesive primer must be used. A time of 72 hours between phosphoric acid anodising and priming is typically used as this represents good working practice.
4. The currently available processes make wide scale use of chromium containing compounds. Obviously chromic acid anodising uses such compounds but they are also found widely in the acid deoxidisers used within the industries. Chromium is also used in the dilute chromate seal solution. Chromium containing process solutions and rinse waters require costly waste treatment to ensure that these compounds are not discharged into the environment. Certain countries also require air monitoring to measure airborne chromium levels around process tanks.
5. The total process cycle time for the currently available processes is typically 120 to 180 minutes. This is increased still further if the anodic coating requires to be sealed. In addition, the immersion times in some of the process solutions can be up to 60 minutes. These factors significantly constrain the capacity of a process line.

6. The use of aggressive acid deoxidisers may cause preferential attack on the alloy constituents resulting in pitting and subsequent rejection of the component. In addition, stains resulting from chromic acid seeping from racking used during anodising are frequently the cause for rejection of chromic acid anodised parts.

The invention consists of a new process whereby a layer of aluminium oxide or hydrated oxide is grown on the surface of an aluminium alloy structure firstly by the application of AC (alternating current) followed by DC (direct current) whilst the structure is immersed in a suitable electrolyte made up of one or more acids.

Thus, there is a need for a process that provides an anodic oxide film on aluminium or aluminium alloy surfaces which provides a porous film suitable for application of adhesive or other coating and which also provides protection against corrosion. Accordingly, the present invention provides a method of producing an anodic oxide film on an aluminium or aluminium alloy workpiece which comprises the steps of:

a) forming an anodic oxide film on the workpiece by AC electrolysis followed by b) subjecting the workpiece to DC electrolysis.

Anodic oxide films produced by the method of the present invention have a duplex or biphasic structure consisting of a thin porous oxide outer phase, typically of less than 1 micrometer having a pore diameter of 20 to 40 nm and a relatively thick, less porous inner oxide layer with a thickness of up to 8 micrometers. The biphasic structure of anodic films of the present invention having a thin porous outer oxide layer and a thicker non-porous inner oxide layer have an optimum combination of properties for subsequent organic coating and corrosion protection of the workpiece, Accordingly in a second aspect the invention provides an aluminium or aluminum alloy workpiece comprising an anodic oxide film wherein the anodic oxide film has an outer phase comprising pores of from 20 to 40 nm and an inner phase that is substantially non porous. Preferably the porous outer phase has a thickness of 0.1 to 1 μm. The less porous inner phase preferably has a thickness of from 1 to 8 μm.

The biphasic nature of the films produced according to the present invention are particularly useful for applications where a coating such as adhesive or paint is to be applied to the component since the pores of the outer phase provide optimum dimensions for retention of adhesive or other coating whilst the substantially non-porous inner phase provides a high degree of corrosion resistance and the films also exhibit comparable or superior peel bond strength compared to conventional anodic oxide films.

The anodic films produced by the method of the present invention have a duplex or biphasic structure in that they comprise an outer porous phase or region which comprises a plurality of pores which are typically from 20-40 nm diameter and which overlies the inner phase or region which is relatively less porous and is substantially non-porous in that those pores which might be present in the inner phases are blind pores or of small diameter so as to provide an effective barrier to corrosion.

The degree of porosity and thickness of the inner and outer oxide phases can be varied to produce films having optimum properties for particular applications by varying the anodising conditions, in particular the bath temperature and composition, AC anodising voltage and time and DC anodising voltage and time.

The anodising solution is an acidic solution, preferably a multi-acid system comprising two or more acids. Multi-acid systems are preferred as they provide greater flexibility in obtaining desired anodic film properties. Preferred anodising solutions include a combination of sulphuric acid and phosphoric acid, preferably the solution comprises from 1 to 10% by volume sulphuric acid and from 1 to 10% phosphoric acid, more preferably from 1.5 to 5% sulphuric acid and from 1.5 to 5% phosphoric acid, most preferably about 2.5% sulphuric acid and about 2.5% phosphoric acid. In addition other acids may be used as well as or in place of phosphoric and sulphuric acid such as oxalic acid or boric acid.

The anodising solution is maintained at a temperature of 15 to 50° C., preferably 25 to 40° C. and more preferably about 35° C.

The AC anodising step is carried out for 30 seconds to 10 minutes at a voltage of 5 to 30 volts, preferably for 1 to 4 minutes at a voltage of 10 to 25 volt and more preferably for about 2 minutes at 15 volts. Preferably a 50 Hz single-phase current is used. The DC anodising step is carried out, preferably immediately after the AC step in the same bath, by applying a DC current at 5 to 30 volts for 1 to 20 minutes, preferably 10 to 25 volts for 2.5 to 12.5 minutes, more preferably at 20 volts for about 10 minutes.

During the initial AC current phase of the anodic cycle it has been found that organic materials are removed from the surface as well as the naturally occurring oxide layer present on the aluminium alloy surface. As a consequence there are no degrease or deoxidise steps required as part of the anodising process. This greatly simplifies the anodising process. Facility and/or costs are reduced due to the need for only an anodise tank and a rinse tank. This compares to six or more tanks required for the current technology processes. The cycle time for the AC/DC anodising process of the present invention is considerably shorter than that for the current technology processes.

When incorporated into an adhesive bond the duplex oxide gives equivalent or better bond strength and durability than the current processes. This process comprises an anodise step followed by rinsing. The duplex oxide does not require the application of adhesive primer following anodising and prior to bonding. Such could be applied if preferred. This is due to the fact that the outer porous oxide does not readily hydrate and the pore structure is therefore stable. The time restrictions between anodising and painting for the duplex oxide coating process can be extended compared to that for the current technology processes. This is dependant on the anodised surfaces being kept clean.

The duplex oxide also provides equivalent or better corrosion protection, compared to the current technology processes, when subjected to industry standard tests. Phosphorous is incorporated into the porous outer oxide layer during the process. Phosphorous is a known corrosion inhibitor in aluminium oxide coatings. Sealing of the aluminium oxide coating produced by this process to increase corrosion protection is not required, but may be preferred.

Further advantages of the process of the present invention include that there are no chromium containing compounds used in any part of the AC/DC anodising process. No air monitoring for chromium compounds is required for this process. The process of the present invention produces less pitting in the aluminium alloy surface due to chemical attack. Stains due to chromic acid will not occur. In addition the present process can be used as part of the friction stir welding process and is suitable for use with aluminium-lithium alloys.

The invention will now be described with reference to the Figures in which.

Figure 4:
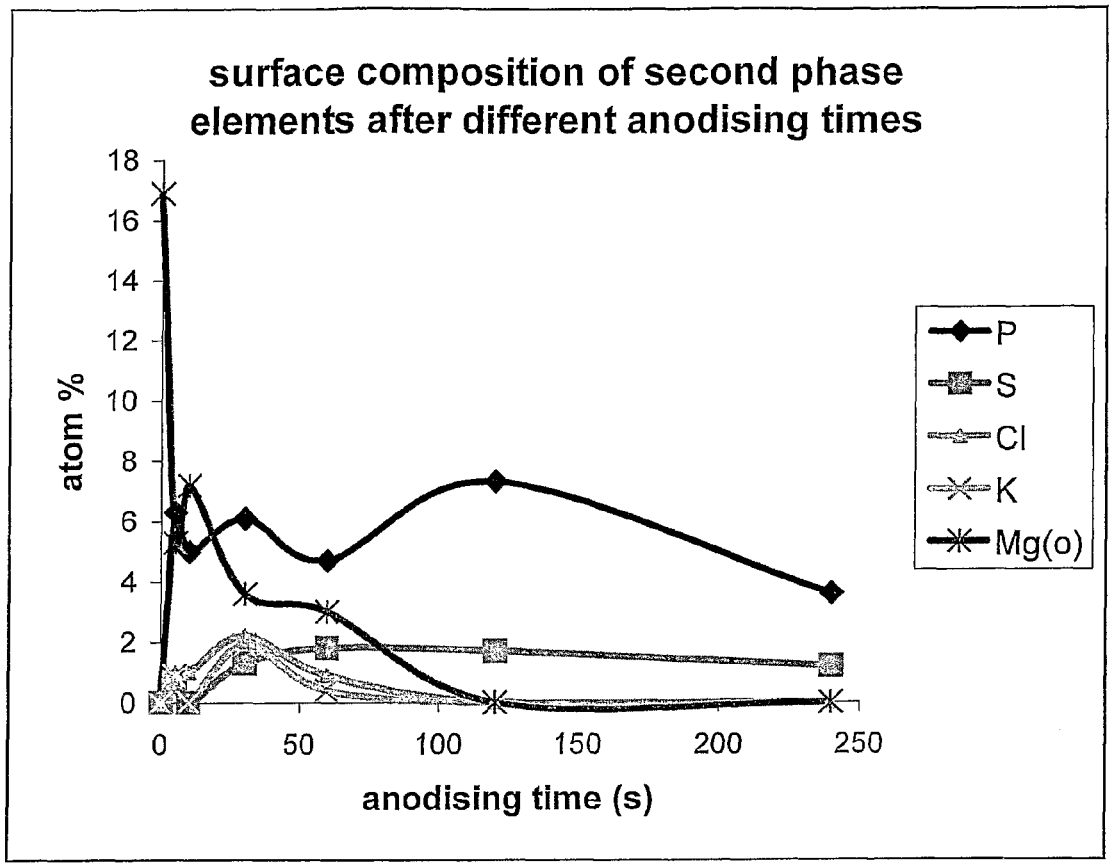

FIG. 4 the percentage of minor elements on the surface of the aluminium alloy when anodised using AC current at 15 volts.

Figure 5:
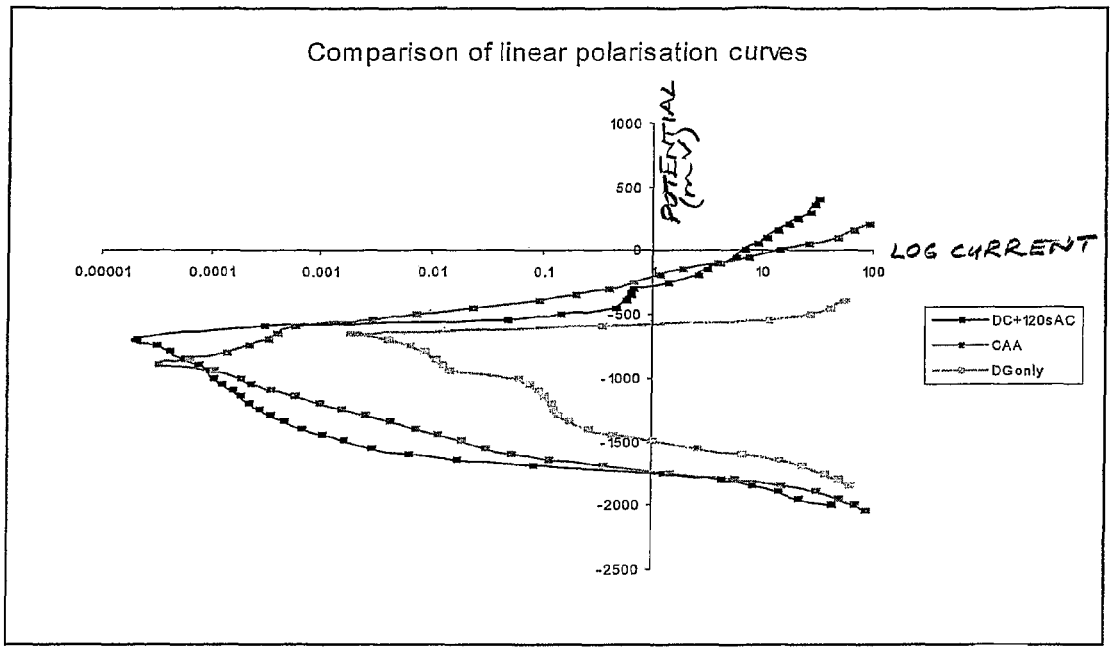

FIG. 5 shows linear polarisation curves comparing the corrosion performance of aluminium alloy surfaces that have been degreased only, chromic acid anodised and AC/DC anodised.

EXAMPLES

Figure 1:
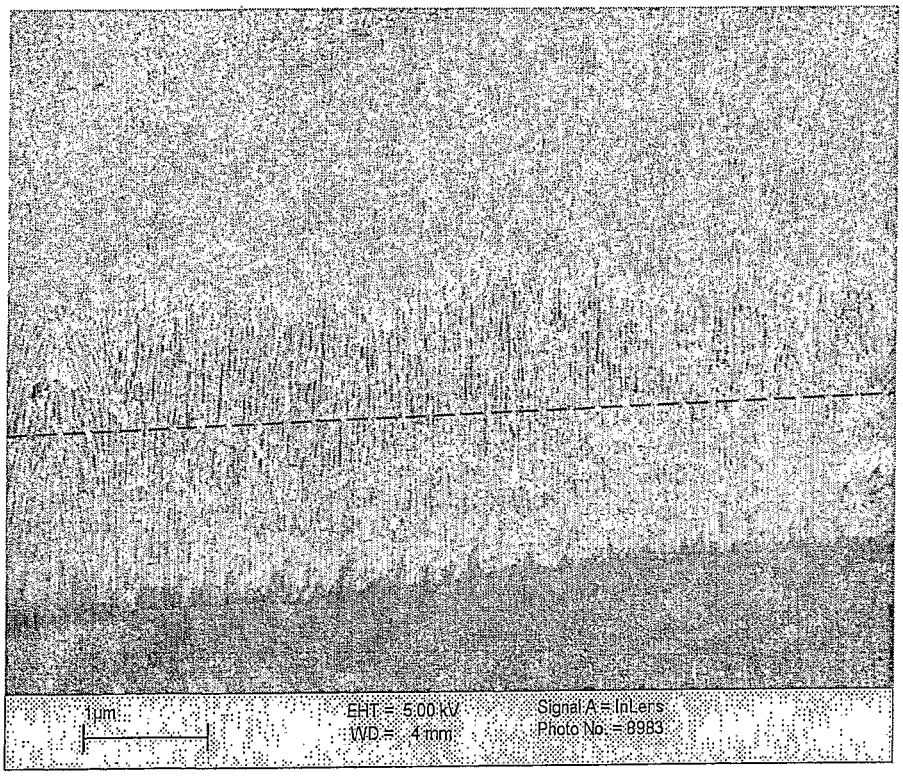
FIG. 1 is a Scanning Electron Microscope (SEM) image of an aluminium oxide coating formed using the AC/DC anodising process of the present invention.

An unclad 2024 aluminium alloy workpiece was connected to the anode of an anodising tank having a series of cathodes along the walls of the tank. No degreasing or deoxidisation treatment was applied to the workpiece prior to anodising. The anodising solution comprised 2.5% sulphuric acid and 2.5% phosphoric acid. The bath was maintained at a temperature of 35° C. The workpiece was anodised with a 50 Hz single phase AC current at 15 volts for 120 seconds. This was immediately followed by DC anodising in the same bath using a DC current at 20 volts for 600 seconds. After anodising the workpiece was rinsed in water to remove traces of anodising solution. Examination of the resulting anodic oxide film showed a film having a duplex structure with an outer layer of approximately 0.5 microns thickness and pores of approximately 30 nanometers in diameter. The inner layer was of approximately 1.5 microns thickness and substantially non porous as shown in FIG. 1.

The anodic oxide film should be strongly bonded to the underlying aluminium alloy substrate, particularly when the component is to be used for adhesive bonding. Subsequent testing of the T-peel bond strength of the anodic oxide films of the invention compared to chromic acid anodising gave improved bond strengths. T-peel bond test results gave values of 167 N for chromic acid anodising and 172 N for the AC/DC anodising process.

Figure 2:
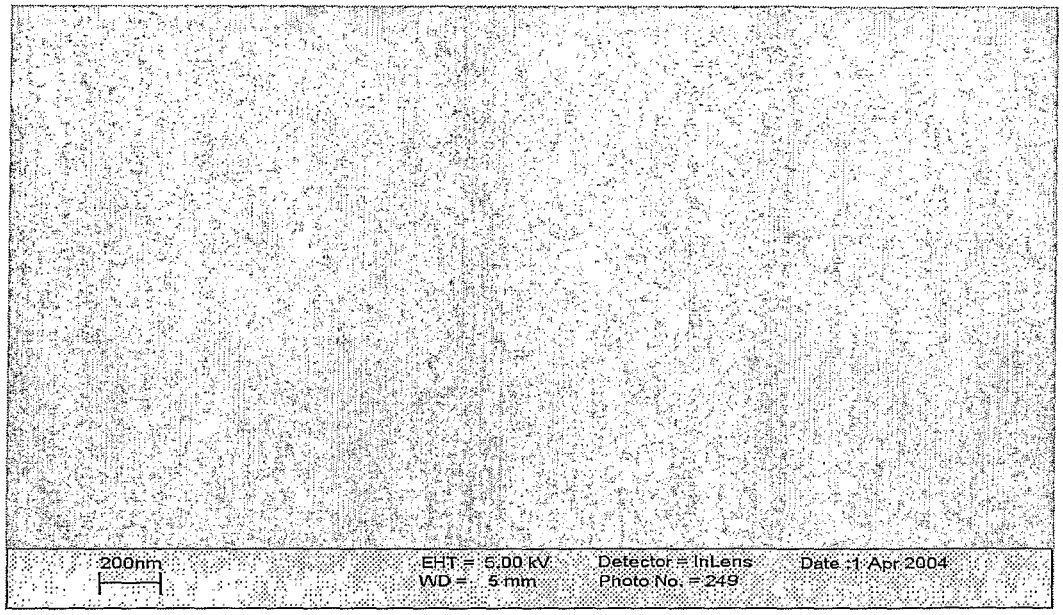
FIG. 2 is an SEM image of an aluminium alloy surface that has been degreased.
Figure 3:
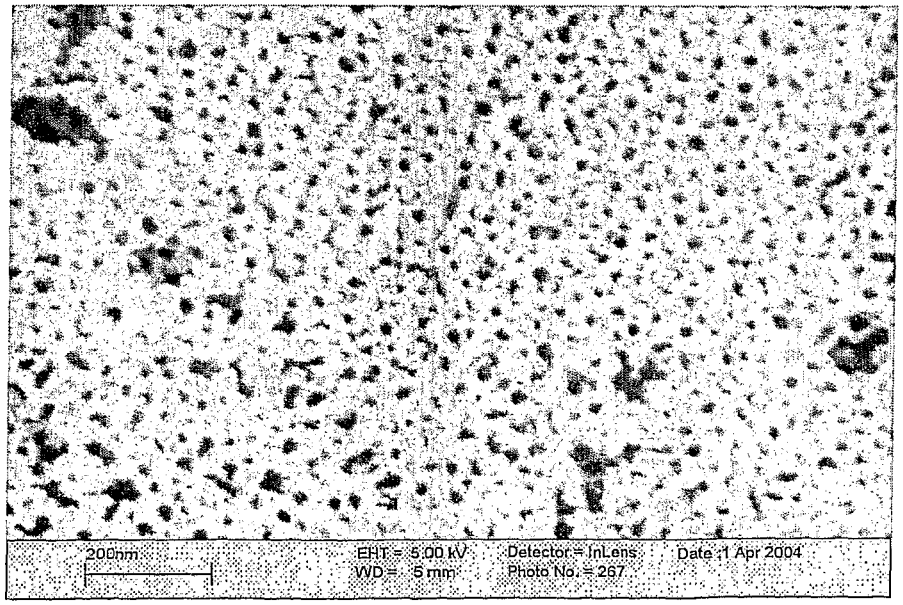
FIG. 3 shows SEM image of an aluminium alloy surface after the AC anodising step of the process.

FIGS. 2 and 3 show SEM images of an aluminium alloy surface that has been degreased and a surface after AC anodising at 15 volts for 240 seconds and demonstrate the etching effect on the aluminium alloy substrate during the AC current part of the process. Due to this it is not necessary to carry out a separate deoxidise process.

FIG. 4 shows how the elemental composition of the surface changes of different elements after the application of differing AC current anodising times. The second phase elements are removed while phosphorous is incorporated into the surface layer.

The curves of FIG. 5 show that the response of the AC/DC anodised surface is similar to or better than the chromic acid anodised surface. In this respect the curves represent linear polarisation curves for degreased only (DG only), chromic acid anodised (CAA), and AC/DC anodised (DC+120 sAC) 2024 material, i.e. 10 minutes DC and 120 seconds AC.

The invention claimed is:

1. A method of producing an anodic oxide film on an aluminum or aluminum alloy workpiece which comprises:

forming an anodic oxide film on the workpiece by AC electrolysis in an anodising solution followed by subjecting the workpiece to DC electrolysis in the anodising solution wherein the anodising solution comprises, in volume %, 1 to 10% of a first acid and 1 to 10% of a second acid.

2. A method according to claim 1 wherein the anodising solution is a multi-acid system comprising more than two acids.

3. A method according to claim 1 wherein the anodising solution is maintained at a temperature of from 15 to 50° C.

4. A method according to claim 1 wherein the AC electrolysis is conducted at a voltage of 5 to 30 volts, for 30 seconds to 10 minutes.

5. A method according to claim 4 wherein the AC electrolysis is conducted at a voltage of 10 to 25 volts for 1 to 4 minutes.

6. A method according to claim 1 wherein the AC electrolysis comprises an AC current being 50 Hz single-phase.

7. A method according to claim 1 wherein the DC electrolysis is conducted at a voltage of 5 to 30 volts for a period of 1 to 20 minutes.

8. A method according to claim 7 wherein the DC electrolysis is conducted at 10 to 25 volts for 2.5 to 12.5 minutes.

9. A method according to claim 2 wherein the first acid comprises sulphuric acid and the second acid comprises phosphoric acid.

10. A method according to claim 2 wherein the anodising solution comprises from 1.5 to 5% sulphuric acid and from 1.5 to 5% phosphoric acid.

11. A method according to claim 2 wherein the anodising solution comprises 2.5% sulphuric acid and 2.5% phosphoric acid, the anodising solution is maintained at 35° C., the AC electrolysis is conducted at 15 volts for 2 minutes and the DC electrolysis is conducted at 20 volts for 10 minutes.

12. A method according to claim 3 wherein the anodising solution is maintained at a temperature of from 25 to 40° C.

13. A method according to claim 1, wherein the method is performed in an environment free from chromium containing compounds.

* * * * *